US010161239B2

(12) United States Patent
Sweatman et al.

(10) Patent No.: US 10,161,239 B2
(45) Date of Patent: Dec. 25, 2018

(54) SYSTEMS AND METHODS FOR THE EVALUATION OF PASSIVE PRESSURE CONTAINMENT BARRIERS

(75) Inventors: Ronald Earl Sweatman, Montgomery, TX (US); Robert Franklin Mitchell, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 853 days.

(21) Appl. No.: 14/238,722

(22) PCT Filed: Aug. 12, 2011

(86) PCT No.: PCT/US2011/047589

§ 371 (c)(1),
(2), (4) Date: May 30, 2014

(87) PCT Pub. No.: WO2013/025188

PCT Pub. Date: Feb. 21, 2013

(65) Prior Publication Data

US 2014/0290940 A1 Oct. 2, 2014

(51) Int. Cl.

| | |
|---|---|
| ***E21B 47/06*** | (2012.01) |
| ***E21B 33/04*** | (2006.01) |
| ***E21B 47/10*** | (2012.01) |

(52) U.S. Cl.

CPC ..... *E21B 47/06* (2013.01); *E21B 33/04* (2013.01); *E21B 47/065* (2013.01); *E21B 47/1005* (2013.01)

(58) Field of Classification Search

CPC .. E21B 47/06; E21B 47/1025; E21B 47/1005; E21B 33/04; E21B 47/065

See application file for complete search history.

(56) References Cited

U.S. PATENT DOCUMENTS

| | | | | |
|---|---|---|---|---|
| 6,427,530 | B1 | 8/2002 | Krueger et al. | |
| 6,513,596 | B2 | 2/2003 | Wester | |
| 6,817,418 | B2 | 11/2004 | Gatherar et al. | |
| 2001/0027865 | A1* | 10/2001 | Wester | E21B 47/06 166/250.01 |
| 2007/0068673 | A1* | 3/2007 | Daily | E21B 47/01 166/254.2 |
| 2011/0067882 | A1* | 3/2011 | Yeriazarian | E21B 43/14 166/369 |
| 2011/0308788 | A1* | 12/2011 | Ravi | E21B 33/14 166/250.01 |

(Continued)

FOREIGN PATENT DOCUMENTS

| | | |
|---|---|---|
| CN | 101253307 | 8/2008 |
| CN | 101438027 | 5/2009 |

(Continued)

OTHER PUBLICATIONS

Milanovic, D., Smith, L., Intetech Ltd., "A Case History of Sustainable Annulus Pressure in Sour Wells—Prevention, Evaluation and Remediation", SPE ATW HPHT Sour Well Desing at the Woodlands TX, SPE 97597, Society of Petroleum Engineers, Inc. (May 2005).*

(Continued)

*Primary Examiner* — Aniss Chad
*Assistant Examiner* — Steven W Crabb
(74) *Attorney, Agent, or Firm* — Kilpatrick Townsend & Stockton LLP

(57) ABSTRACT

Systems and methods for the advance, real-time and/or post-event evaluation of inaccessible passive pressure containment barriers using an iterative process.

20 Claims, 3 Drawing Sheets

(56) References Cited

U.S. PATENT DOCUMENTS

| | | | | |
|---|---|---|---|---|
| 2012/0017673 | A1* | 1/2012 | Godager | E21B 41/0085 73/152.51 |
| 2012/0247831 | A1* | 10/2012 | Kaasa | E21B 21/08 175/25 |
| 2014/0039797 | A1* | 2/2014 | Gonzales | G01V 99/005 702/11 |

FOREIGN PATENT DOCUMENTS

| | | |
|---|---|---|
| CN | 201391271 | 1/2010 |
| CN | 101793146 | 8/2010 |
| EP | 2582909 | 3/2015 |
| GB | 2466861 | 7/2010 |
| WO | 0049268 | 8/2000 |
| WO | 2012144991 | 10/2012 |

OTHER PUBLICATIONS

Australian Application No. 2011374974, Office Action dated Apr. 16, 2015, 3 pages.

Canadian Application No. 2,843,127, Office Action dated Apr. 24, 2015, 2 pages.

Canadian Application No. 2,843,127, Office Action dated Sep. 18, 2015, 2 pages.

Chinese Application No. 201180072590.3, Office Action dated Dec. 31, 2015, 23 pages.

European Application No. 11870944.3, Extended European Search Report dated Dec. 22, 2015, 7 pages.

International Application No. PCT/US2011/047589, International Preliminary Report on Patentability dated Aug. 26, 2013, 24 pages.

International Application No. PCT/US2011/047589, International Search Report and Written Opinion dated Dec. 13, 2011, 14 pages.

Sultan et al., 0TC-19286-MS: Real-Time Casing Annulus Pressure Monitoring in a Subsea Hp/Ht Exploration Well, Annual Offshore Technology Conference, May 5, 2008, pp. 1-11.

European Application No. 11870944.3, Office Action dated Jun. 6, 2017, 7 pages.

Halal et al., Casing Design for Trapped Annular Pressure Buildup, SPE Drilling and Completion, vol. 9, No. 2, Jun. 1, 1994, pp. 107-114.

* cited by examiner

SYSTEMS AND METHODS FOR THE EVALUATION OF PASSIVE PRESSURE CONTAINMENT BARRIERS

CROSS-REFERENCE TO RELATED APPLICATIONS

The priority of PCT Patent Application No. PCT/US2011/47589, filed on Aug. 12, 2011, is hereby claimed, and the specification thereof is incorporated herein by reference.

STATEMENT REGARDING FEDERALLY SPONSORED RESEARCH

Not applicable.

FIELD OF THE INVENTION

The present invention generally relates to systems and methods for the evaluation of passive pressure containment barriers. More particularly, the present invention relates to the advance, real-time and/or post-event evaluation of inaccessible passive pressure containment barriers using an iterative process.

BACKGROUND OF THE INVENTION

One of the methods used for the containment of formation fluids in a well is the use of a weighted drilling fluid, where the hydrostatic pressure of this fluid prevents fluid influx into the well. This method is considered passive, since no direct human intervention is needed for the effectiveness of this method, in contrast to, for example, a mechanical blowout preventer. As a well is drilled, a series of casings and liners are cemented to the formation. As illustrated in FIG. 1, which is a cross-sectional view of part of a well and the surrounding formation 110, the cementing process typically seals the weighted drilling fluid 106 within an annulus between the top of the cement 108 and the top of the casing 102 or the top of the liner 104. Typically, the weighted drilling fluid 106 in the annulus is inaccessible after cementing, particularly in subsea, deepwater wells. One property of the weighted drilling fluid 106 trapped within the annulus is that it increases in volume with an increase in temperature and that it decreases in volume with an increase in pressure. For example, the "ideal gas" has the following relation between volume V, pressure P and temperature T (R is a constant related to the type of gas):

$$V = \frac{R * T}{P}$$

It can be seen that an increase in temperature T causes an increase in volume V. It can also be seen that an increase in pressure P causes a decrease in volume V. Real wellbore fluids are more complex than this simple model, however. For example, various fluid models are described by Poling, et al. in *The Properties of Gases and Liquids, Fifth Edition*, McGraw-Hill Book Company, New York, N.Y., 2001, sections 4.43-4.46. Furthermore, the well casing has the properties of expanding due to temperature increase, internal pressure increase, and/or external pressure decrease. Details of this behavior are described, for example, by Timoshenko and Goodier in *Theory of Elasticity*, McGraw-Hill Book Company, New York, N.Y., 1970, pp. 68-71; by Halal and Mitchell in *Casing Design for Trapped Annular Pressure Buildup*, SPE Drilling & Completion, Society of Petroleum Engineers, Richardson, Tex., 1993, pp. 179-190; and by Halal, et al. in *Multi-String Casing Design with Wellhead Movement*, SPE Production Operations Symposium, Oklahoma City, Okla., 1997, pp. 477-484.

When the annulus is cemented, the drilling fluid contained in the annulus has a specific initial temperature and pressure profile. The initial pressure profile was chosen to have the proper passive properties to prevent fluid influx into the annulus and also to prevent fracturing of the formation adjacent to the annulus. As the well is drilled to deeper depths, well operations (e.g. circulation of drilling fluids, cementing operations, and/or shut-in periods), may alter the temperatures in the well. Altering the temperature will change the pressure in the closed annulus. For example, an increase in temperature would cause an increase in the fluid volume. This fluid volume increase in an enclosed volume will then result in a pressure increase, needed to preserve the original volume by compressing the fluid. The overall calculation is further complicated by the pressure and thermal behavior of fluids in other annuli and the pressure and thermal behavior of the casings and liners. The resulting pressure change in the annulus may adversely effect the passive pressure containment barrier by either falling below the formation pressure, allowing fluid influx, or by fracturing the formation, which will result in the loss of annulus fluid volume. In FIG. 2, for example, a graph based on modeled data for an actual well illustrates how the annulus pressure can decrease with time when circulating fluids have cooled the weighted drilling fluid in the annulus. This decrease in hydrostatic pressure has the potential to allow fluid influx, indicating a possible failure of the passive pressure containment barrier. Monitoring is therefore, recommended by API RP 96 or may be required by government regulations (e.g. BOEMRE) to ensure well control and containment of formation fluids.

Well Cat™, which is a commercial software application marketed by Landmark Graphics Corporation, and other applications have been used to predict and analyze temperature changes and pressure changes of the weighted drilling fluid used as a passive pressure containment barrier, however, such techniques are limited by their failure to use the results in an iterative workflow to monitor and evaluate the weighted drilling fluid as a passive pressure containment barrier.

SUMMARY OF THE INVENTION

The present invention therefore, overcomes one or more deficiencies in the prior art by providing systems and methods for the advance, real-time and/or post-event evaluation of inaccessible passive pressure containment barriers using an iterative process.

In one embodiment, the present invention includes a method for the evaluation of passive pressure containment barriers in a well, comprising: a) determining a change in temperature within each passive pressure containment barrier caused by a well construction operation using initial conditions for the well; b) determining a change in pressure within each passive pressure containment barrier caused by the change in temperature using the initial conditions; c) determining if any passive pressure containment barrier may be adversely effected by the change in pressure using a computer processor; d) performing remedial action relative to each passive pressure containment barrier that may be adversely effected; e) identifying new initial conditions for the well using the change in temperature and the change in pressure or a change in temperature and a change in pressure from actual field data; and f) repeating steps a)-e) for a next well construction operation using the new initial conditions for the well if the well is not complete.

In another embodiment, the present invention includes a non-transitory program carrier device tangibly carrying computer executable instructions for the evaluation of passive pressure containment barriers in a well, the instructions being executable to implement: a) determining a change in temperature within each passive pressure containment barrier caused by a well construction operation using initial conditions for the well; b) determining a change in pressure within each passive pressure containment barrier caused by the change in temperature using the initial conditions; c) determining if any passive pressure containment barrier may be adversely effected by the change in pressure; d) performing remedial action relative to each passive pressure containment barrier that may be adversely effected; e) identifying new initial conditions for the well using the change in temperature and the change in pressure or a change in temperature and a change in pressure from actual field data; and f) repeating steps a)-e) for a next well construction operation using the new initial conditions for the well if the well is not complete.

Additional aspects, advantages and embodiments of the invention will become apparent to those skilled in the art from the following description of the various embodiments and related drawings.

BRIEF DESCRIPTION OF THE DRAWINGS

The present invention is described below with references to the accompanying drawings in which like elements are referenced with like reference numerals, and in which.

DETAILED DESCRIPTION OF THE PREFERRED EMBODIMENTS

The subject matter of the present invention is described with specificity, however, the description itself is not intended to limit the scope of the invention. The subject matter thus, might also be embodied in other ways, to include different steps or combinations of steps similar to the ones described herein, in conjunction with other present or future technologies. Moreover, although the term "step" may be used herein to describe different elements of methods employed, the term should not be interpreted as implying any particular order among or between various steps herein disclosed unless otherwise expressly limited by the description to a particular order. While the present invention may be applied in the oil and gas industry, it is not limited thereto and may also be applied in other industries to achieve similar results.

Method Description

Figure 1:
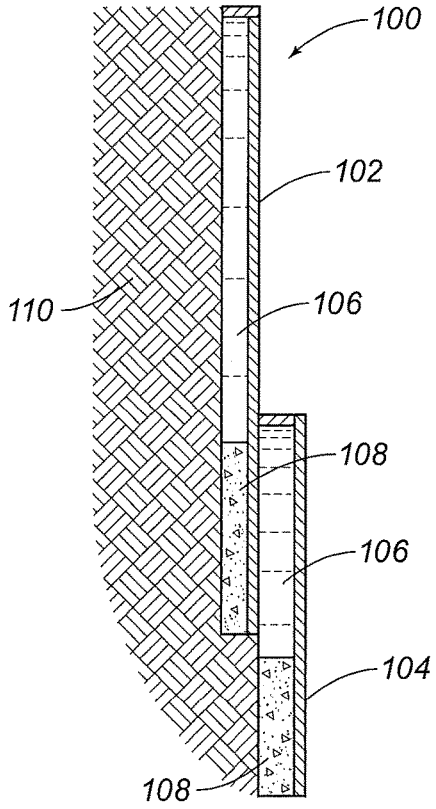
FIG. 1 is a cross sectional view illustrating part of a well and the surrounding formation.
Figure 2:
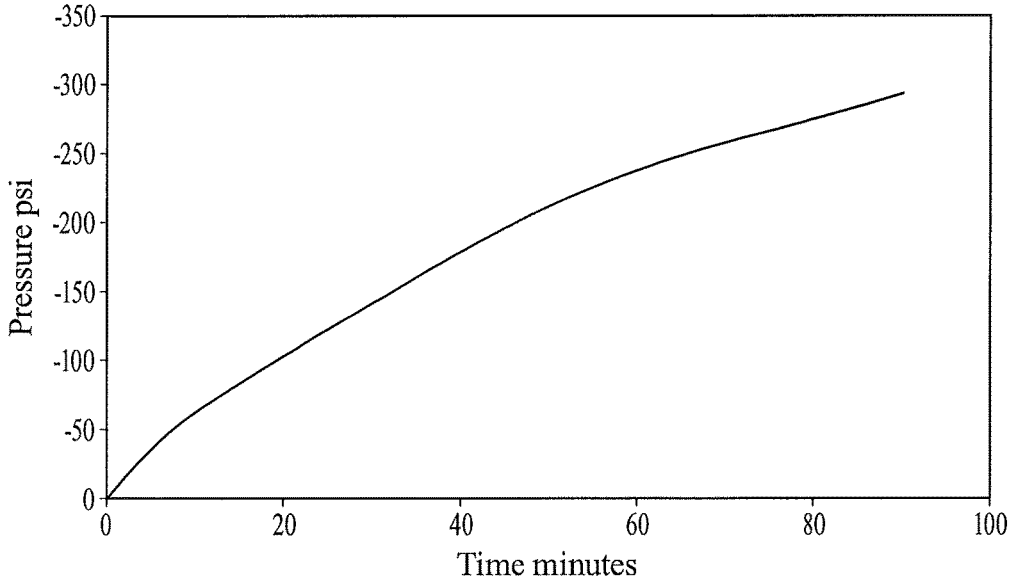
FIG. 2 is a graph illustrating pressure as a function of time for a weighted drilling fluid as it is cooled within an annulus.
Figure 3:
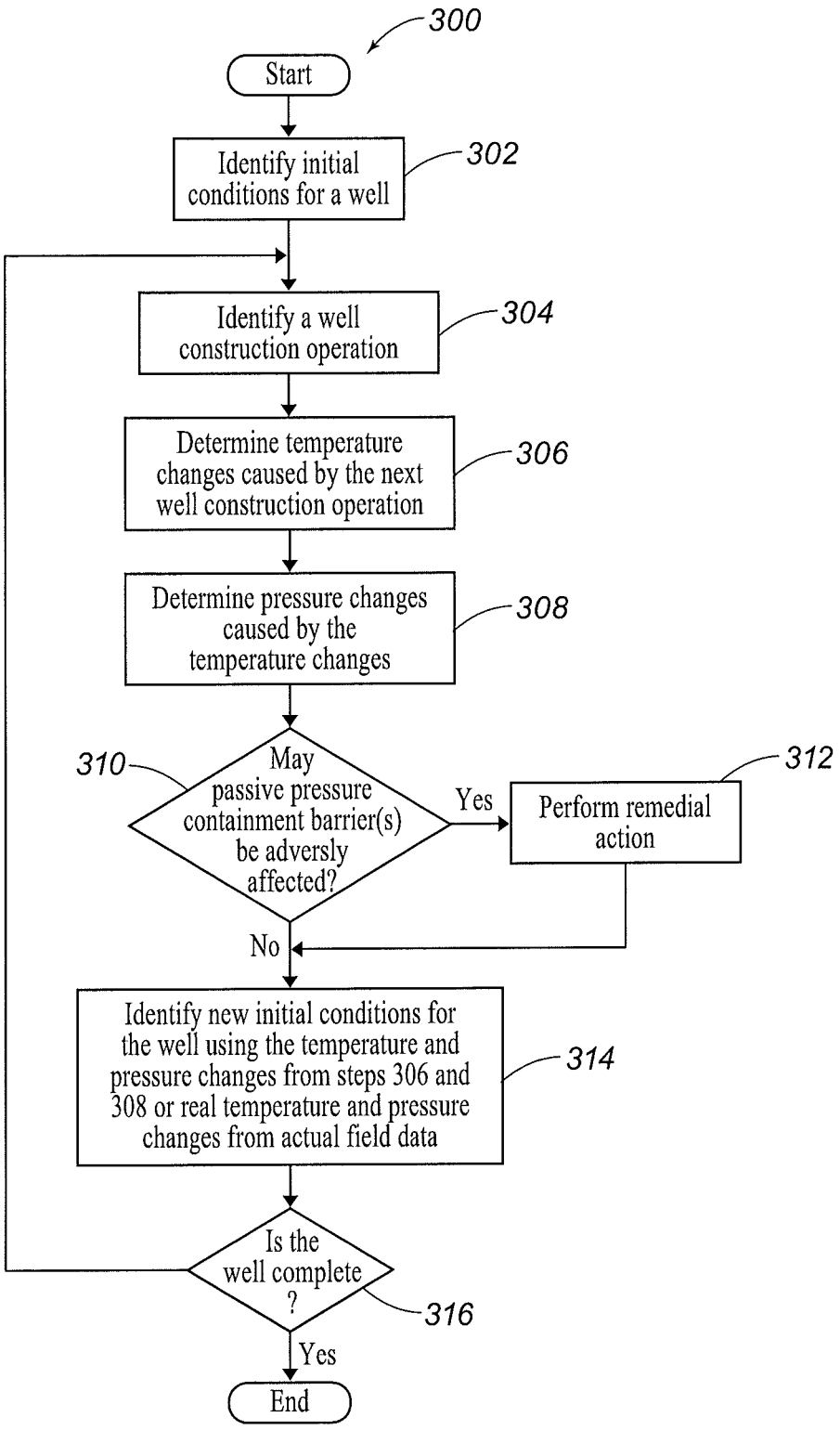
FIG. 3 is a flow diagram illustrating one embodiment of a method for implementing the present invention.

Referring now to FIG. 3, flow diagram illustrates one embodiment of a method 300 for implementing the present invention.

Figure 4:
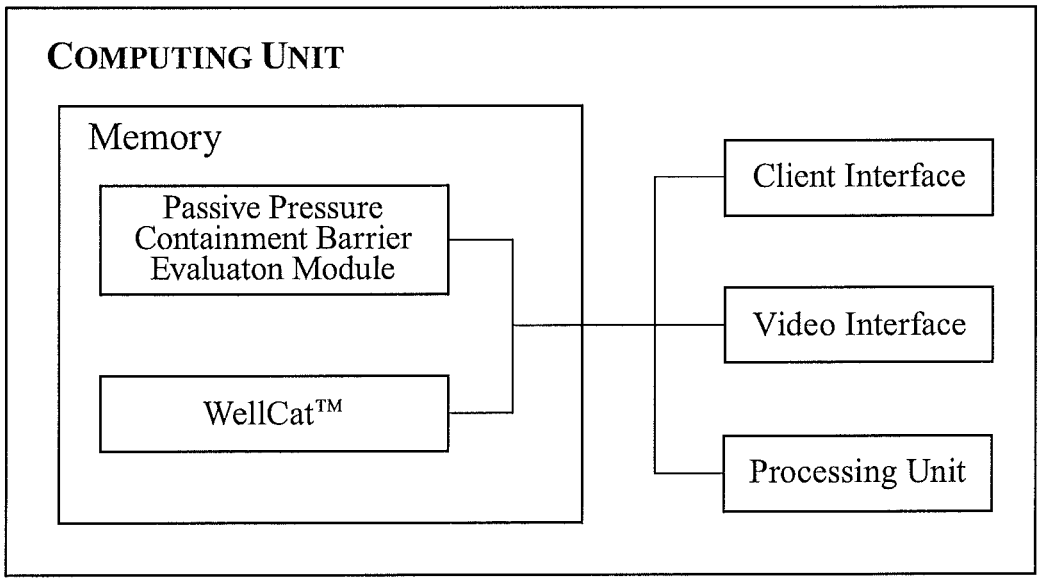
FIG. 4 is a block diagram illustrating one embodiment of a system for implementing the present invention.

In step 302, the initial conditions for a given well are identified using the client interface and/or the video interface described in reference to FIG. 4. Alternatively, the initial conditions for a given well may be automatically identified using any well known real-time data collection software. These conditions may consist of, but are not limited to, the initial geothermal temperature, the well foundation, the formation fluid pressures, the formation fracture pressures and the water depth for a subsea well.

In step 304, a well construction operation is identified using the client interface and/or the video interface described in reference to FIG. 4. Alternatively, the well construction operation may be automatically identified using any well known real-time data collection software. The well construction operation may consist of, but is not limited to, drilling ahead, tripping out for a bit change, tripping in, running casing or liners, installing tubing, performing a cementing operation, waiting on cement or shutting in the well.

In step 306, temperature changes caused by the well construction operation identified in step 304 are determined within the passive pressure containment barrier using the initial conditions identified in step 302 and techniques well known in the art, which are described by Aadnoy, et al. in *Advanced Drilling and Well Technology*, Society of Petroleum Engineers, Richardson, Tex., 2009, pp. 798-815 and incorporated herein by reference.

In step 308, pressure changes caused by the temperature changes determined in step 306 are determined within the passive pressure containment barrier using the initial conditions identified in step 302 and techniques well known in the art, which are described by Halal and Mitchell in *Casing Design for Trapped Annular Pressure Buildup*, SPE Drilling & Completion, Society of Petroleum Engineers, Richardson, Tex., 1993, pp. 179-190; and by Halal, et al. in *Multi-String Casing Design with Wellhead Movement*, SPE Production Operations Symposium, Oklahoma City, Okla., 1997, pp. 477-484 and incorporated herein by reference.

In step 310, the method 300 determines if any passive pressure containment barrier may be adversely effected by the pressure changes determined in step 308. For example, the pressure changes determined in step 308 may simply be compared to a maximum pressure rating for the passive pressure containment barrier to determine if any passive pressure containment barrier is adversely effected. Optionally, the pressure changes determined in step 308 may be compared to the actual formation pore pressure to determine if any passive pressure containment barrier may be adversely effected when there is a reduction in annulus pressure, which could initiate a fluid influx and adversely effect a passive pressure containment barrier. Another option might compare the pressure changes determined in step 308 for a pump with actual pressure changes for the pump to determine if any deviation may adversely effect any passive pressure containment barrier. Other comparisons with the pressure changes determined in step 308, however, may be preferred to automatically determine if any passive pressure containment barrier may be adversely effected. If none of the passive pressure containment barriers may be adversely effected, then the method 300 proceeds to step 314. If any passive pressure containment barrier may be adversely effected, then the method 300 indicates which passive pressure containment barrier may be adversely effected and proceeds to step 312.

In step 312, remedial action is performed relative to the passive pressure containment barrier(s) that may be adversely effected using techniques well known in the art.

For example, increased casing pressure might require venting the annulus to relieve pressure or installing a lock ring to secure the casing seat, which are manually done but may be automated. In this manner, remedial action can be taken before any passive pressure containment barrier is actually breached.

In step 314, new initial conditions for the well are identified using the temperature and pressure changes from steps 306 and 308, respectively, or real temperature and pressure changes within the passive pressure containment barrier from actual field data. The new initial conditions for the well may be automatically identified or they may be identified using the client interface and/or the video interface described in reference to FIG. 4. In either case, the real temperature and pressure changes detected from actual field data may be preferred over the predicted/calculated temperature and pressure changes from steps 306 and 308, respectively.

In step 316, method 300 determines if the well is complete by flagging the last well construction operation. Other techniques well known in the art may be used, however, to determine if the well is complete. If the well is not complete, then the method 300 returns to step 304 where the next well construction operation is identified and the remaining steps are repeated using the results from step 314. By the iterative-direct comparison between predicted and/or actual results, anomalous conditions that may adversely effect any passive pressure containment barrier can be identified and remedial action taken before any passive pressure containment barrier is actually breached. If the well is complete, then the method 300 ends.

Examples

In the planning phase of a well, a compilation of probable well construction operations can be made and appropriate simulations of these operations could be used to identify both the potential problems that may adversely effect any passive pressure containment barrier during a well construction operation and the appropriate remediation methods to be used. In this preferred application of the method 300 in FIG. 3, remedial action may include, but is not limited to, revising the simulated well construction operation to alter the simulated well conditions (e.g. temperatures/pressures) in order to prevent a breach of any passive pressure containment barrier.

Real-time applications would simulate the well construction operations simultaneously with the actual well construction operations to predict potential problems that may adversely effect any passive pressure containment barrier and/or to identify deviations from the predicted results as potential problems. In this application of the method 300 in FIG. 3, remedial action may include, but is not limited to i) revising mud properties because actual field conditions do not correspond to simulated model conditions; or ii) investigating field conditions to identify and correct anomalous pump pressures. The revised model or corrected field conditions could then be used in order to prevent a breach of any passive pressure containment barrier.

Post-event analysis of well data could be used to understand how the well construction operation and passive pressure containment barrier(s) may have failed, so that similar problems could be avoided during the next well construction operation. In this application of the method 300 in FIG. 3, remedial action may include, but is not limited to revising the next well construction operation to alter the well conditions (e.g. temperatures/pressures) in order to prevent a breach of any passive pressure containment barrier.

As an example of a real-time application, the next well construction operation identified in step 304 may be a cementing operation. In step 306, the temperature changes caused by the cementing operation may indicate that drilling mud in the annulus above the cement has cooled while waiting on the cement to set. In step 308, the pressure changes may reveal a pressure drop in the annulus due to thermal contraction (temperature changes) of the drilling mud in the annulus. As a result of the reduced pressure in the annulus falling below the pore pressure of a producing interval, a gas influx may be identified in step 310 as potentially having an adverse effect on a passive pressure containment barrier. A lock ring therefore, may be installed on the annulus in step 312 to prevent a breach of the passive pressure containment barrier. The method 300 then proceeds to steps 314 and 316 in the manner described hereinabove. Because this exemplary application describes a cementing operation as the next well construction operation, the method 300 will return to step 304 to identify the conditions for the next well construction operation after the cementing operation.

System Description

The present invention may be implemented through a computer-executable program of instructions, such as program modules, generally referred to as software applications or application programs executed by a computer. The software may include, for example, routines, programs, objects, components, and data structures that perform particular tasks or implement particular abstract data types. The software forms an interface to allow a computer to react according to a source of input. WellCat™ may be used to implement the present invention. The software may also cooperate with other code segments to initiate a variety of tasks in response to data received in conjunction with the source of the received data. The software may be stored and/or carried on any variety of memory media such as CD-ROM, magnetic disk, bubble memory and semiconductor memory (e.g., various types of RAM or ROM). Furthermore, the software and its results may be transmitted over a variety of carrier media such as optical fiber, metallic wire and/or through any of a variety of networks such as the Internet.

Moreover, those skilled in the art will appreciate that the invention may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present invention. The invention may be practiced in distributed-computing environments where tasks are performed by remote-processing devices that are linked through a communications network. In a distributed-computing environment, program modules may be located in both local and remote computer-storage media including memory storage devices. The present invention may therefore, be implemented in connection with various hardware, software or a combination thereof, in a computer system or other processing system.

Referring now to FIG. 4, a block diagram illustrates one embodiment of a system for implementing the present invention on a computer. The system includes a computing unit, sometimes referred to as a computing system, which contains memory, application programs, a client interface, a video interface and a processing unit. The computing unit is only one example of a suitable computing environment and is not intended to suggest any limitation as to the scope of use or functionality of the invention.

The memory primarily stores the application programs, which may also be described as program modules containing computer-executable instructions, executed by the computing unit for implementing the present invention described herein and illustrated in FIG. 3. The memory therefore, includes a passive-pressure containment-barrier evaluation module, which enables the methods illustrated and described in reference to FIG. 3 and integrates functionality from the remaining application programs illustrated in FIG. 4. The passive-pressure containment-barrier evaluation module, for example, may be used to execute many of the functions described in reference to steps 302, 304, 310, 314 and 316 in FIG. 3. WellCat™ may be used, for example, to execute the functions described in reference to steps 306 and 308 in FIG. 3.

Although the computing unit is shown as having a generalized memory, the computing unit typically includes a variety of computer readable media. By way of example, and not limitation, computer readable media may comprise computer storage media. The computing system memory may include computer storage media in the form of volatile and/or nonvolatile memory such as a read only memory (ROM) and random access memory (RAM). A basic input/output system (BIOS), containing the basic routines that help to transfer information between elements within the computing unit, such as during start-up, is typically stored in ROM. The RAM typically contains data and/or program modules that are immediately accessible to and/or presently being operated on by the processing unit. By way of example, and not limitation, the computing unit includes an operating system, application programs, other program modules, and program data.

The components shown in the memory may also be included in other removable/non-removable, volatile/non-volatile computer storage media or they may be implemented in the computing unit through application program interface ("API"), which may reside on a separate computing unit connected through a computer system or network. For example only, a hard disk drive may read from or write to non-removable, nonvolatile magnetic media, a magnetic disk drive may read from or write to a removable, non-volatile magnetic disk, and an optical disk drive may read from or write to a removable, nonvolatile optical disk such as a CD ROM or other optical media. Other removable/non-removable, volatile/non-volatile computer storage media that can be used in the exemplary operating environment may include, but are not limited to, magnetic tape cassettes, flash memory cards, digital versatile disks, digital video tape, solid state RAM, solid state ROM, and the like. The drives and their associated computer storage media discussed above provide storage of computer readable instructions, data structures, program modules and other data for the computing unit.

A client may enter commands and information into the computing unit through the client interface, which may be input devices such as a keyboard and pointing device, commonly referred to as a mouse, trackball or touch pad. Input devices may include a microphone, joystick, satellite dish, scanner, or the like. These and other input devices are often connected to the processing unit through a system bus, but may be connected by other interface and bus structures, such as a parallel port or a universal serial bus (USB).

A monitor or other type of display device may be connected to the system bus via an interface, such as a video interface. A graphical user interface ("GUI") may also be used with the video interface to receive instructions from the client interface and transmit instructions to the processing unit. In addition to the monitor, computers may also include other peripheral output devices such as speakers and printer, which may be connected through an output peripheral interface.

Although many other internal components of the computing unit are not shown, those of ordinary skill in the art will appreciate that such components and their interconnection are well known.

While the present invention has been described in connection with presently preferred embodiments, it will be understood by those skilled in the art that it is not intended to limit the invention to those embodiments. It is therefore, contemplated that various alternative embodiments and modifications may be made to the disclosed embodiments without departing from the spirit and scope of the invention defined by the appended claims and equivalents thereof.

What is claimed is:

1. A computer-implemented method, the method comprising:

performing, by a processor, a process including:

determining, by the processor, one or more initial conditions associated with a well, the well containing a passive pressure containment barrier associated with a breach condition, and the one or more initial conditions being determined using field data associated with the well;

identifying, by the processor, a well construction operation to be performed on the well;

causing, by the processor, performance of the well construction operation using the one or more initial conditions;

determining, by the processor, a change in temperature within the passive pressure containment barrier caused by performing the well construction operation using the one or more initial conditions;

determining, by the processor, a change in pressure within the passive pressure containment barrier caused by the change in temperature;

predicting, by the processor, a potential for the breach condition of the passive pressure containment barrier to be satisfied;

automatically, by the processor, causing performance of a remedial action associated with the passive pressure containment barrier, the remedial action preventing the breach condition from being satisfied; and determining, by the processor, one or more new initial conditions for the well using the change in temperature and the change in pressure; and repeating, by the processor, the process for a new well construction operation, wherein repeating the process includes causing performance of the new well construction operation on the well using the one or more new initial conditions to prevent the breach condition from being satisfied.

2. The computer-implemented method of claim 1, wherein the passive pressure containment barrier is inaccessible.

3. The computer-implemented method of claim 1, wherein the change in temperature is determined by calculating the change in temperature and the well construction operation and the one or more initial conditions for the well are simulated.

4. The computer-implemented method of claim 3, wherein the change in pressure is determined by calculating the change in pressure.

5. The computer-implemented method of claim 4, wherein determining the potential for the breach condition of the passive pressure containment barrier-to be satisfied is done during a planning phase for the well.

6. The computer-implemented method of claim 5, wherein the remedial action comprises revising the simulated well construction operation to alter the simulated initial conditions for the well.

7. The computer-implemented method of claim 4, wherein determining the potential for the breach condition of the passive pressure containment barrier to be satisfied is done in real-time during an actual well construction operation represented by the simulated well construction operation.

8. The computer-implemented method of claim 7, wherein the remedial action comprises comparing actual field conditions for the well with the simulated initial conditions for the well to identify anomalous conditions.

9. The computer-implemented method of claim 1, wherein determining the potential for the breach condition of the passive pressure containment barrier-to be satisfied is done after an actual well construction operation.

10. The computer-implemented method of claim 9, wherein the remedial action comprises revising the new well construction operation to alter the one or more new initial conditions for the well.

11. A non-transitory program carrier device tangibly carrying computer executable instructions, the instructions being executable to implement:

performing a process including:

determining one or more initial conditions associated with a well, the well containing a passive pressure containment barrier associated with a breach condition, and the one or more initial conditions being determined using field data associated with the well;

identifying a well construction operation to be performed on the well;

performing the well construction operation using the one or more initial conditions;

determining a change in temperature within the passive pressure containment barrier caused by performing the well construction operation using one or more initial conditions;

determining a change in pressure within each passive pressure containment barrier caused by the change in temperature;

predicting a potential for the breach condition of the passive pressure containment barrier to be satisfied;

automatically performing a remedial action associated with the passive pressure containment barrier, the remedial action preventing the breach condition from being satisfied; and determining one or more new initial conditions for the well using the change in temperature and the change in pressure; and repeating the process for a new well construction operation, wherein repeating the process includes performing the new well construction operation on the well using the one or more new initial conditions to prevent the breach condition from being satisfied.

12. The program carrier device of claim 11, wherein the passive pressure containment barrier is inaccessible.

13. The program carrier device of claim 11, wherein the change in temperature is determined by calculating the change in temperature and the well construction operation and the one or more initial conditions for the well are simulated.

14. The program carrier device of claim 13, wherein the change in pressure is determined by calculating the change in pressure.

15. The program carrier device of claim 14, wherein determining the potential for the breach condition of the passive pressure containment barrier to be satisfied-is done during a planning phase for the well.

16. The program carrier device of claim 15, wherein the remedial action comprises revising the simulated well construction operation to alter the simulated initial conditions for the well.

17. The program carrier device of claim 14, wherein determining the potential for the breach condition of the passive pressure containment barrier to be satisfied is done in real-time during an actual well construction operation represented by the simulated well construction operation.

18. The program carrier device of claim 17, wherein the remedial action comprises comparing actual field conditions for the well with the simulated initial conditions for the well to identify anomalous conditions.

19. The program carrier device of claim 11, wherein determining the potential for the breach condition of the passive pressure containment barrier-to be satisfied is done after an actual well construction operation.

20. The program carrier device of claim 19, wherein the remedial action comprises revising the new well construction operation to alter the one or more new initial conditions for the well.

* * * * *